United States Patent [19]

Mayo

[11] 4,147,557

[45] Apr. 3, 1979

[54] METHOD AND APPARATUS FOR FEEDING A SUGAR CANE MILL

[76] Inventor: Aryan R. Mayo, 407 E. Del Monte Ave., Clewiston, Fla. 33440

[21] Appl. No.: 874,933

[22] Filed: Feb. 3, 1978

[51] Int. Cl.[2] ..... C13D 1/02

[52] U.S. Cl. ..... 127/6; 100/173; 127/5; 127/43; 198/365; 198/369; 198/530; 198/599; 198/601

[58] Field of Search ..... 127/2, 5, 6, 43; 198/599, 601, 365, 369, 530; 100/173, 188, 193

[56] References Cited

U.S. PATENT DOCUMENTS

| | | | |
|---|---|---|---|
| 787,102 | 4/1905 | Lorenz | 127/6 |
| 1,809,261 | 6/1931 | Adams | 198/530 |
| 2,292,890 | 8/1942 | Mitchell | 198/599 |
| 2,406,541 | 8/1946 | Hewlett | 100/173 X |
| 2,669,829 | 2/1954 | Pugh | 198/599 X |
| 2,785,683 | 3/1957 | Davidson | 198/530 X |
| 3,500,565 | 3/1970 | Smith | 198/599 X |
| 3,597,163 | 8/1971 | Hengel | 127/6 |
| 3,719,290 | 3/1973 | Voigtldender | 198/601 |
| 3,999,650 | 12/1976 | Gerhardt | 198/601 X |
| 4,043,832 | 8/1977 | Leibig | 127/6 |

*Primary Examiner*—Sidney Marantz

*Attorney, Agent, or Firm*—Cushman, Darby & Cushman

[57] ABSTRACT

The feed blanket is conditioned prior to entering the mill to provide more uniformity of thickness and to control maximum thickness. Overfeeding is prevented by self-regulated by-passing of excess feed. Plural mills of a milling tandem can be made to operate in a parallel fashion while the remaining ones continue to operate in their usual series fashion.

17 Claims, 14 Drawing Figures

METHOD AND APPARATUS FOR FEEDING A SUGAR CANE MILL

FIELD OF THE INVENTION

There are several means used for the extraction of the sugar containing juices from sugar cane. The two principal ones are milling and diffusion. The invention relates to the first or milling process.

BACKGROUND OF THE INVENTION

In the milling process several mills, each being comprised of three compression rollers, (although there are some that use only two and others that use as many as five), compress the cane between the rollers causing the cane juice to be extracted. Usually water or diluted juice from a following mill is added ahead of a given mill to aid in the extraction process. The mills are arranged sequentially in what is called a milling tandem resulting in a series process in which the cane, previously chopped up by knives or shredders, enters the first of these mills. In the first mill, the chopped or shredded cane is compressed, partially extracting the sugar-containing juices and then discharged to a conveying means to be similarly treated by a second mill, then a third, then a fourth, and so forth. The number of mills in a tandem vary, but there are usually four to seven in a tandem.

There are two principal techniques as applied to cane milling with roller mills. In one the material discharged by a preceding mill is conveyed to a hopper located ahead of the following mill and from which this mill feeds. This technique requires a high degree of cane disintegration by shredders ahead of the milling process. It also requires that a large amount of water or diluted juice be added to the cane between mills to cause it to be in a semi-fluid form so that it can flow properly from the hopper into the mill.

The other principal milling technique for roller milling tandems requires less cane preparation or shredding ahead of the milling process as well as less liquid application between mills, but for proper milling performance this second milling technique requires that the material be delivered to the mill entrance in the form of a feed blanket of a width closely equal to the cylindrical length of the mill rollers.

The capacity of a milling tandem is often limited by only some of its mills, such as would be the case of milling tandems using some older and some newer mills, the older units imposing their limitation on the new units due to the series nature of the milling operation. Limitation in capacity is imposed on a milling tandem also as a result of the high moisture in the bagasse being discharged by the last mill of a tandem grinding at relatively large capacity since this moisture content must be within certain levels for the bagasse to burn properly as a fuel in the boiler furnaces that generate the power and steam required to process the cane into sugar.

It should be borne in mind that in the conventional milling process referred to, considerable emphasis is placed in the formation of a uniform feed blanket at the beginning of the milling process and to its maintenance throughout this milling process.

In the past, due to the series nature of the milling process together with the conveying means for the material presently being used between mill, when the flow of material thru any given mill is interrupted, it results in a total milling tandem stoppage, or as in the case of a factory with a single tandem, a total factory shut down, a fairly common occurrence which is often a main cause of lost production for sugar cane factories.

With the conveying devices between mills presently used, which dead end at the entrance of the following mill, thruput must be kept below such level that would cause a momentary over feeding of any of the mills in the tandem since, if this occurs, the mills thus overfed will choke, or refuse all feed, causing shut down of variable duration and therefore lost production.

In the following description the term bagasse is used when referring to the fibrous residue of the cane after having been processed by a first set of mill rolls and any mill thereafter.

SUMMARY OF THE INVENTION

Under the above or similar circumstances a significant increase in milling capacity can be achieved by operating in parallel two successive mills in a tandem while continuing to operate in series the remaining mills of said tandem, that is, someplace in an otherwise series process to split the flow of material being processed into two parts, generally but not necessarily equal, and feed each of these parts to two sequentially placed mills to be processed separately by these. Their separate discharge is recombined into one common stream to be processed either in a series fashion by the following mills, or by another set of similarily arranged parallel mills, or if the two paralleled mills in question are located at the end of the tandem to be conveyed away from the tandem usually to the furnaces.

The invention relates to means by which two successive mills in a series milling tandem can be made to operate in a parallel fashion without disturbing these mills from their original series position in the tandem creating a combination series-parallel type of process which can result in considerably increased milling capacity for a given tandem.

The invention also provides for the mills operating in parallel to revert to a series operation when better sugar recovery can be achieved by so doing.

The invention provides means for forming a uniform feed blanket for each mill regardless of whether that mill is operating in series or in parallel.

The invention eliminates lost production due to overfeeding a mill by providing means to by-pass any mill equipped with the device of the invention. Furthermore it provides means that permit partial bypassing of a mill so equipped which can result in increased thruput. By using the device of the invention, which provides a second discharge outlet beyond a given mill, thruput can be increased and if momentary overfeeding takes place the excess material is carried over to the second opening leading to the next mill avoiding the overfeeding condition that otherwise would cause the mill to choke.

The mill feeding device of the invention is not limited solely to obtaining a paralleling effect since the device when used to feed just a single mill without the requirement of paralleling is a superior technique, due to the special way in which it conditions the bagasse prior to delivering it to the mill and by the ease with which it permits a mill to be by-passed, which in plants operating 24 hours seven days a week as is common in the industry, is a tremendous advantage. Its self by-passing characteristics also permit thruputs a lot closer to maximum capacity which results in substantially increased mill capacity.

The "parallel-series-parallel" milling method comprises paralleling the first two mills and the last two mills of a tandem while the remaining mills operate in series with each other. This process eliminates the two major limitations in thruput to a milling tandem today. The first mill in a milling tandem grinding at very high rates not only has to cope with a much larger volume of material than the rest of the mills in the tandem due lack of cane compaction by a previous unit but it also has to cope with the very large volume of juice present in that cane which upon compression tends to flow against the flow of cane being conveyed towards the mill creating serious feeding difficulties to the mill which limit the thruput of the milling tandem. Paralleling the first two mills will eliminate this problem.

The other limitation to high thruputs is the rise in moisture content in the bagasse off the last mill. This bagasse is used as fuel in the factory's boilers and the increased moisture prevents the bagasse from burning properly in the furnaces forcing either a reduction in thruput or the burning of expensive auxiliary fuel. Prior to this the imbibition or wash water applied to the last mill to provide for the washing out of the sugar from the cane fiber is usually curtailed causing substantial recovery losses from that mill. Under this circumstance paralleling the two last mills, each taking only half of the thruput results not only in improved bagasse moisture with the consequent fuel savings but improved sugar recovery if imbibition is returned to normal levels. The rest of the mills in the tandem faced neither with the bulk nor the high liquid content in cane faced by the first mill or the necessity to maintain a low moisture content in the bagasse as in the last mill usually can accept considerably higher grinding rates. The net effect is a markedly increased milling capacity.

There are also other applications of the device and method of the present invention in which a different arrangement, such as a series-parallel, parallel-series or series-parallel-series combination is desirable. In the case of a series-parallel combination this would be desirable for example when for some reason larger mills are going to be followed by smaller mills in a tandem. Parallel-series would be desirable when smaller existing mills are to be followed by additional larger mills, and the series-parallel-series combination would be desirable when existing intermediate mills are of lesser capacity than those installed ahead of and following them.

As can be seen, the device of the invention is very versatile, one of its principal functions being that it will provide, when equipped as described herein, means to parallel any two series arranged mills in a milling tandem without disturbing them from their existing position, in varying arrangements and for various purposes.

It is an object of this invention to provide means by which two successive mills in a series milling tandem can be made to operate in parallel while maintaining their series position in the said tandem and if desirable to be made to revert to a series operation without process interruption.

It is an object of this invention to provide means to split the flow of material between two mills being paralleled accurately in a given proportion that is not significantly effected by changes is thruput, and to accomplish this in a manner that does not effect the transversal distribution of the material being handled.

It is an object of this invention to provide means by which the transversal distribution of the material entering the device remains substantially unchanged as it is treated by the device while providing means by which the spaced, intermittent flow of material being discharged through the first opening leading to the first mill is transformed into a continuous feed blanket, this feed blanket being treated to eliminate abrupt variations in thickness by means that convert these to more desirable gradual ones.

It is an object of this invention to provide means to prevent mill overfeeding, a condition that causes a mill to stop up or choke causing it to refuse all feed, by providing an adjustable opening at the entrance leading to the given mill that limits that maximum thickness of the feed blanket that may be formed, while providing means by which the material reaching this opening in excess of that required to form a feed blanket of the desired maximum thickness is conveyed beyond this opening to a second opening leading to the following mill.

It is an object of this invention to provide means by which the remaining mills of a milling tandem can continue to operate when a given mill equipped with apparatus of the invention is temporarily or permanently taken off the line. Thus it provides means to by-pass at will, and without process interruption, a mill so equipped.

The principles of the invention will be further discussed with reference to the drawings wherein preferred embodiments are shown. The specifics illustrated in the drawings are intended to exemplifly, rather than limit, aspects of the invention.

Figure 1:
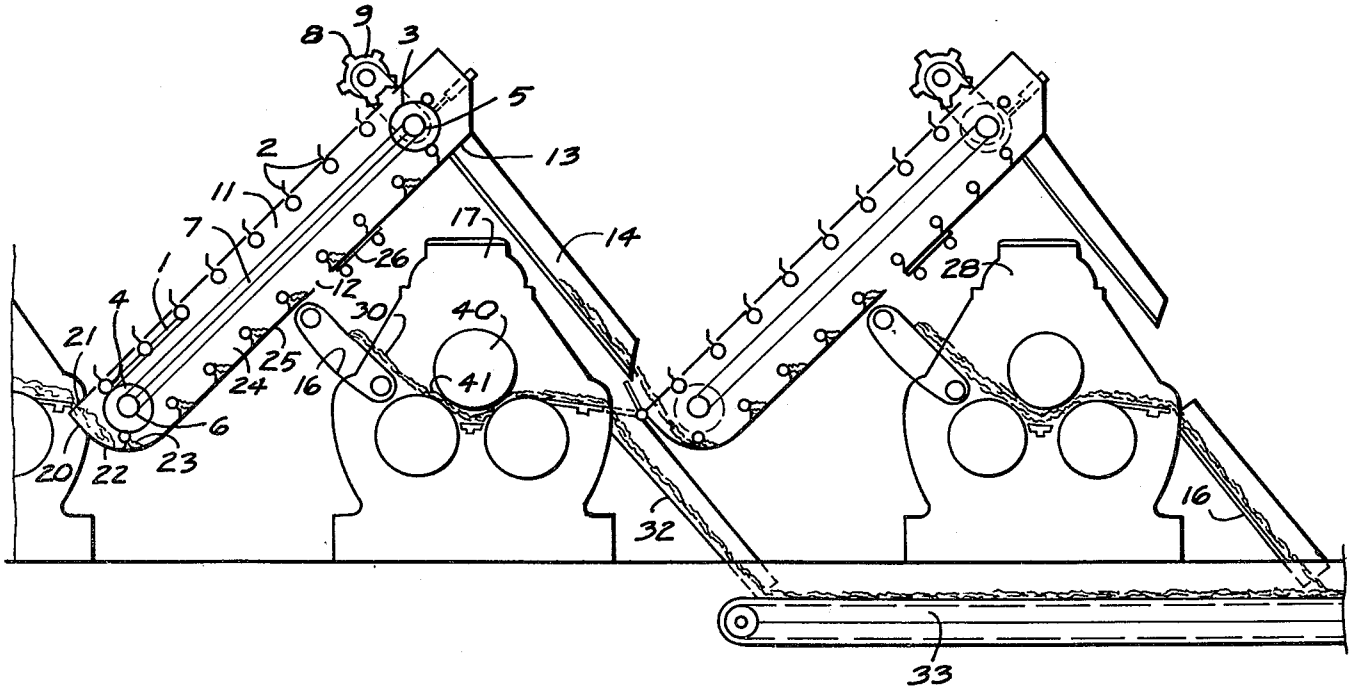
FIG. 1 is a fragmentary longitudinal sectional view of a sugar cane milling tandem, two mills being shown, equipped with a first embodiment of the feeding device of the present invention.

FIGS. *2a–2f* are fragmentary longitudinal sectional views of a portion of the apparatus of FIG. 1, showing the operation of the gate and the relation of the rakes to the opening as the feeding device is operated; and FIGS. *3a* and *3b* show details of the function of the feed conditioner in two states of operation.

Figure 4:
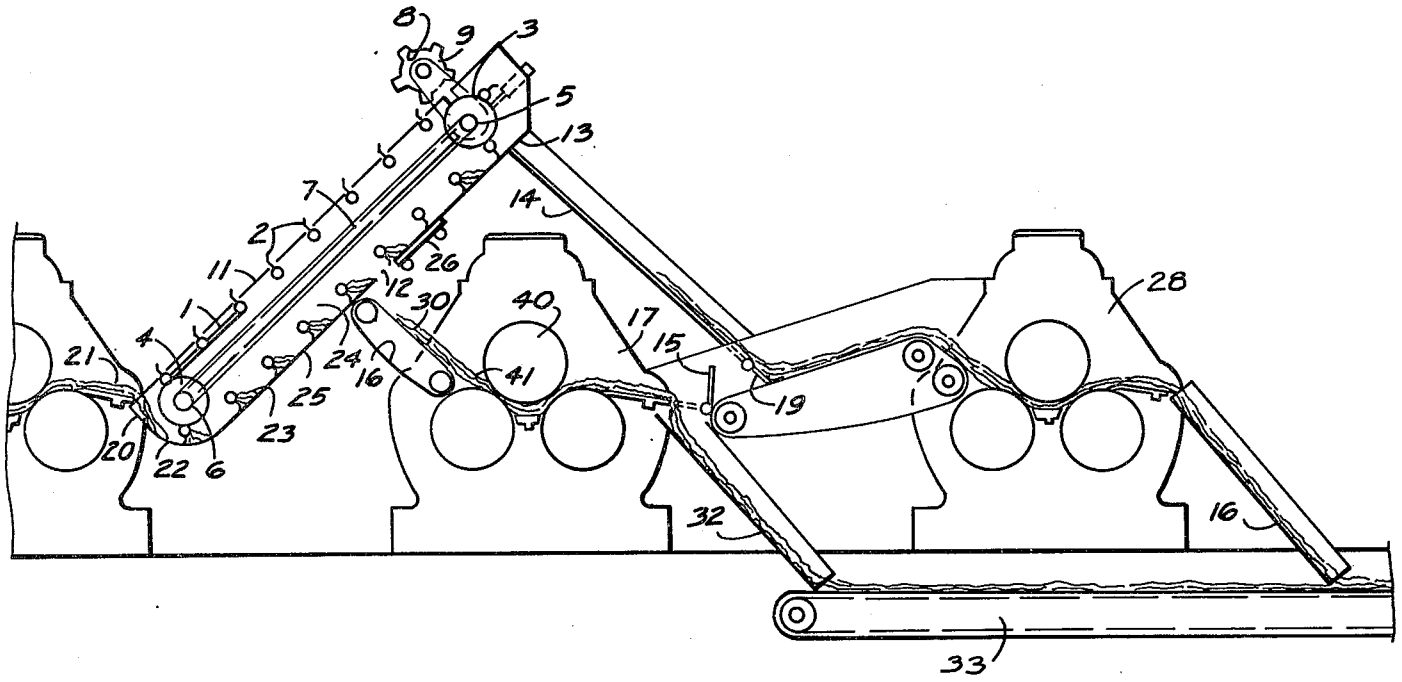

FIG. 4 is a fragmentary longitudinal sectional view similar to FIG. 1, of a second embodiment of the feeding device of the present invention.

Figure 5:
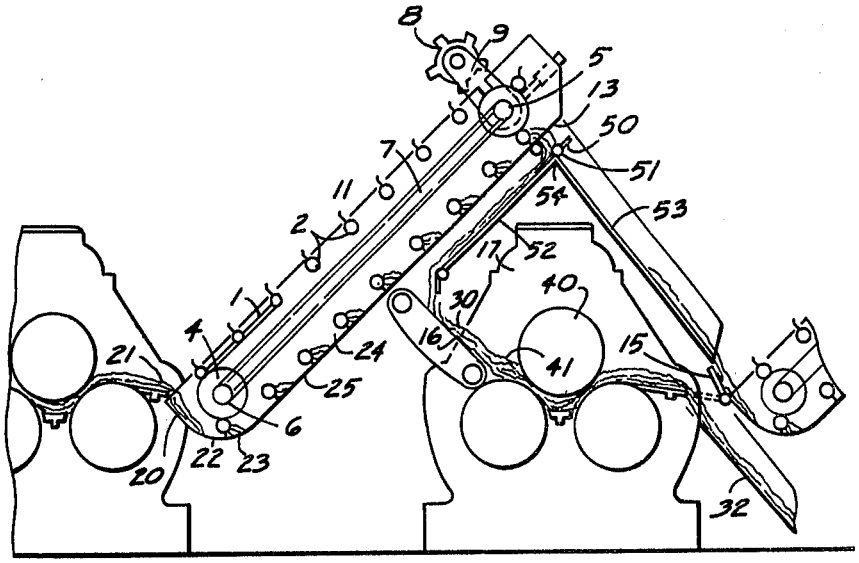

FIG. 5 is a fragmentary longitudinal sectional view similar to FIG. 1, of a third embodiment of the feeding device of the present invention; and FIGS. *6a–6c* are fragmentary longitudinal sectional views of a portion of the Apparatus of FIG. 5, showing various stages in the operation of the feeding device of this embodiment.

GENERAL DESCRIPTION

The present invention relates to a mill feeding, paralleling and by-passing device for sugar cane mills and the like including a conveying and metering means comprising a carrier adapted for location between two successive mills in a milling tandem, to carry the bagasse from one mill to the next while specially conditioning it for metering or dividing. This conveying and metering means further includes a stationary housing or casing with its internal width approximately equal to the cylindrical length of the mill rollers of the mill which it feeds and has at its rear end a top entrance through which bagasse discharged from a previous mill reaches the interior of the housing in a transversally uniform manner. The housing contains rakes or slats attached to spaced parallel chains in a spaced relationship, which in their conveying action cause the continuous flow of material entering the housing to be broken into distinct and separate loads or piles without effecting its transversal distribution. These loads or piles are separated by void spaces, each of a certain minimum length as they are conveyed over the bottom of the casing towards two successive outlet openings. The first opening is provided with a gate that opens longitudinally, in the direction of the flow of material and is provided with a synchronized open-close action timed with the passing of the rakes. Thus, the gate of the first opening, when open, allows the bagasse being conveyed by one rake to pass thru the momentarily open aperture and enter a first mill. Then this gate closes, to allow the next rake-load to pass over the closed opening and be conveyed to the second opening leading to a second mill. This action is made repetitive, so that every-other-rake-load is permitted to discharge through the first opening leading to the first mill while the remaining rakeloads are discharged through the second opening leading to the conveyor feeding the second mill. The speed, rake height and rake spacing together with the angle of inclination of the bottom of the casing are selected in relation to the quantity of bagasse being conveyed and its density, so as to cause the individual loads being conveyed by subsequent rakes to be separated by a given minimum distance. This provides a time-lapse for the gate closing action to take place when there is not material being discharged through the opening, a necessary requirement to maintain splitting accuracy of the device, at varying thruput or flow rates with fibrous material such as cane that tend to bridge-over restricted openings.

The aboved-described apparatus thus provides means to divide the flow of material entering it between two series arranged mills in a given proportion which is not substantially effected by changes in flow rate or the varying fibrous characteristics of the material and without affecting the transversal distribution or uniformity of the material entering the device for the purpose of paralleling these two mills.

The invention provides means by which the bagasse discharged by the first of the two mills in question may be directed either to a conveying means for conveyance to a third mill for further processing or, as in the case of the last two mills of a tandem, away from the milling tandem altogether. It also provides for stopping the gate in its open or in its closed position. Thus, with the gate opening and closing in synchronism with the passing of the rakes as described previously the flow of bagasse is split, one portion reaching the first of two mills, which, after processing, is discharged onto a conveyor leading away from the milling tandem or to a third mill for further processing. The other portion, discharged from a second mill, is made to flow on to the same conveying means as that on to which the previous mill discharged, thus resulting in the parallel operation for these two mills. If series operation is required the gate under the first opening is stopped in its open position. Thus, all the bagasse flows through this opening into the first of the two mills and after processing is directed through a suitable diverting gate on to the conveyor leading to the second mill. Thus, the totality of the bagasse flowing is first processed by the first mill and then by the second resulting in series operation of the two mills.

The invention provides for means to by-pass at will a mill equipped with the device of the invention. Thus, means are provided to hold the gate in its closed position which will result in the total flow of bagasse to be conveyed over the closed first opening leading to the first mill and be discharged through the second opening leading to a second mill, thus accomplishing by-passing of this mill without process interruption. Similarly, the second mill may be by-passed by stopping the gate in its open position. Thus, the total flow of bagasse is allowed to enter through this opening leading to the first mill and no bagasse then reaches the second. Bagasse discharged from the first mill is directed by means of a diverting gate away from the conveyor leading to the second mill and onto that leading away from these two mills to a third mill, or if these are the last mills of the tandem to be conveyed away from the tandem.

Since the flow of bagasse discharged through the opening leading to the first mill is of intermittent, interrupted nature as a result of the separating action of the rakes upon the flow of the bagasse, assisted by the action of the dividing gate, the invention provides means to form this interrupted flow into a continuous feed blanket prior to the material being fed to the mill. Thus, it provides a device consisting primarily of a moving apron-like conveying surface located between the opening and the mill, its conveying surface inclined downwardly at a selected angle, related to the fiber length, moisture content and density of the bagasse being handled and thus to the sequential position in the tandem of the mill in question. The angle of inclination of the conveying surface, its relative position with respect to the discharged opening and its speed relative to the mill roller speed causes the formation of a continuous feed blanket, free of abrupt changes in thickness and of a desired thickness in relation to thruput and to the sequential position of the mill in the tandem.

The device further provides for means to prevent momentary overfeeding which usually results in mill chokes, by providing means to limit the maximum thickness to which the blanket can be formed. Thus, it provides adjustable means to limit the gate aperture. Because of the relative position of the aperture to the uppermost reach of the inclined conveying surface, a blanket thickness cannot be exceeded that is in a relation to the size of the opening. If bagasse reaches the aperture in excess of that required to form a given maximum blanket thickness, the aperture would quickly build up with bagasse causing the excess to pass over the built-up opening, as if it were closed, and be conveyed to the second opening, in effect by-passing the first mill.

DETAILED DESCRIPTION OF THE PRESENTLY PREFERRED EMBODIMENTS

FIG. 1 shows a preferred embodiment of the feeding device, in conjunction with two of the sequentially arranged mills which it feeds. The feeding device includes conveying and metering means, feed conditioning means and the necessary chutes and gates to direct the flow of material to and from these mills.

The conveying and metering means as shown on FIG. 1 include a stationary housing or casing 11 within which conveying rakes 2 move the bagasse entering the opening 21 toward two successive outlet openings 12 and 13. These rakes are attached in a spaced relationship to two or more transversally spaced parallel chains 1 which ride over the upper sprockets 3 and lower sprockets 4 and are given through suitable driving means (not shown) a pre-determined traveling speed. The surface and angle of the rear boot plate 20 is such as to cause the bagasse, regardless of its wetness, to freely slide over it. The upward angle of inclination of the bottom plate 25, the height of the rakes 2, their spacing, and their traveling speed are selected in combination to achieve an effect that is to be described further on.

Opening 12 is of a transversal dimension equal to the effective material carrying width of bottom plate 25, which in turn is made substantially equal, or approximately equal, to the cylindrical length of the mill rollers 40. The dimension of opening 12 in the direction of material flow is selected in relation to the spacing of the rakes as described below. Opening 13 is also of a transversal dimension equal to the effective material carrying width of bottom plate 25 while its dimension in the direction of material flow is made sufficient to allow full discharge of the material being transported by the rakes 2.

Adjacently above the first opening 12, slide gate 26 is located with its upper surface adjacent to the bottom surface of the bottom plate 25 of the housing or casing 11. Its closing and opening action is in a longitudinal direction with respect to the flow of material. The slide gate 26 is mounted on suitable bearings or slides (not shown) that permit it to open and close opening 12 while at the same time providing a conveying surface over which the material can be conveyed over the opening when this gate is closed. When the device of the invention is used for paralleling, the slide gate 26 is imparted through suitable hydraulic, pneumatic or mechanial means C a timed, reciprocating opening and closing action synchronized with the passing of the rakes over the opening 12 so that it will open and remain momentarily open to allow the material being conveyed by one rake to be discharged fully through said open aperture, then rapidly closing so that the following rake load is carried across the closed opening over the upper surface of the closed gate, and to the second opening 13 to be discharged therethrough. This action is repetitive, so that every-other-rake-load is discharged through the first opening and the remaining rake-loads are discharged through the second opening 13. If desirable, other proportions than 1:1 are possible, such as results by using control C to provide a timed gate action that allows two rake-loads out of every three to be discharged through opening 12 while the third is discharged through opening 13, or three out of four, etc. The gate 26 is provided with latch means L for stopping and holding the gate 26 in its open or in its closed position, and the latch L includes provisions for regulating the degree of opening of gate 26 by means of adjustable stops (not shown in detail).

The apparatus described above functions as follows:

The material entering the casing 11 in a uniform width through entrance 21 at the rear of the housing from a supply conveyor or from a previous mill as shown, slides over the inclined rear plate 20 onto curved section 22, momentarily accumulating there until a passing rake 23 picks it up and conveys it onto the inclined bottom plate 25 of the casing. The height of the rakes, their spacing, as well as their traveling speed are selected so that in conjunction with the selected angle of inclination of the bottom conveying plate 25, the material, as it is being conveyed, is caused to accumulate against the conveying rake causing a void space to be created between subsequent rake loads. The void space thus created provides a time lapse sufficient for the gate 26 to close the aperture 12 while there is no material being transported over the aperture. Since fibrous material such as sugar cane bagasse tends to bridge over, and not flow through partially restricted openings, such as would be the case during the latter part of the closing stroke or the early part of the opening stroke of the gate described above, if the void spaces between loads did not exist it would be difficult to maintain a reasonably constant split of the flow of material at different levels of thruput and with other variables that occur in cane milling such as changes in fiber length and moisture content of the material.

The gate closing speed is selected so that the gate 26 reaches its closed position prior to the arrival, at the lower edge of the opening 12, of the leading edge of the load to be transported to the second opening 13, while its opening speed is selected equal or nearly equal to the rake speed and is so timed that it will start to open as the rake transporting the load to be discharged thru the second opening, reaches the lower, or leading edge of the opening 12, the opening edge of the gate moving as it opens in unison with the rake just above it.

FIGS. **2*a*–2*f* show the rakes 2 in relation to the opening 12 as well as the opening and closing action of gate 26** with respect to the rakes, their load and the void spaces between these loads.

FIG. **2*a* shows rake b already across the open aperture 12 having just discharged its load through said open aperture. Rake c still is a distance away from the leading edge 12*a* of the aperture. Gate 26** is about to start its closing stroke.

FIG. **2*b* shows gate 26 having completed its closing stroke while the leading edge of the load carried by rake c has advanced to the edge 12*a* of opening 12**.

FIG. **2*c* shows the load carried by rake c being conveyed over the top surface of the closed gate 26 with rake c located immediately above edge 12*a* of opening 12. Gate 26** is about to start its opening stroke at a speed equal to that of the moving rake c.

FIG. **2*d* shows rake c half-way across the partially open opening 12 its load partially on the top surface of the gate surface and partially on the conveyor bottom plate 25**.

FIG. **2*e* shows rake c fully across the now open aperture 12. It should be noted that the opening stroke of the gate 26 is adjustable to limit the size of the opening and in that manner it is possible to limit the maximum thickness of the feed mat that will be formed at the mat forming device 16 located immediately below the opening 12**.

Figures 2A, 2B, 2C, 2D, 2E, 2F:
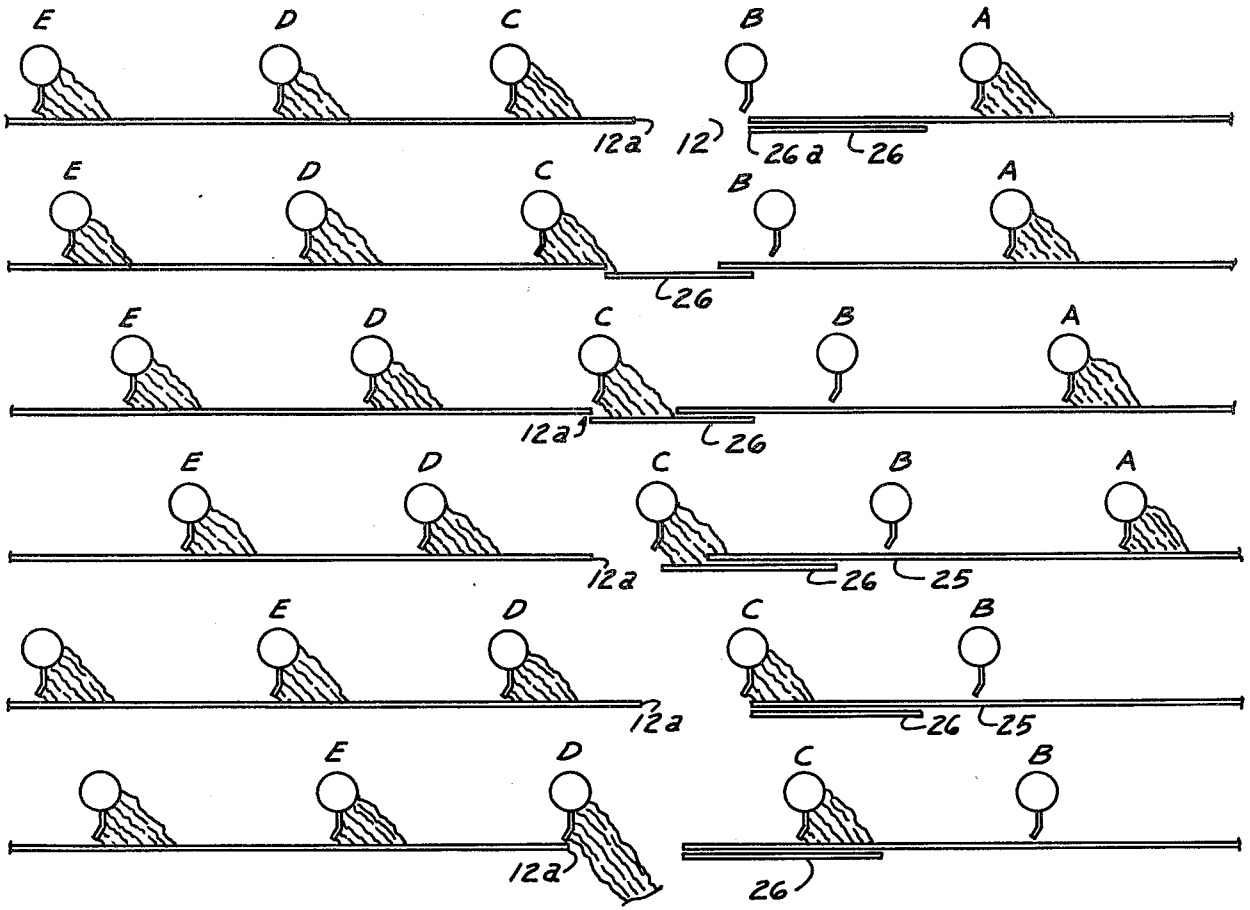

FIG. **2*f* shows the next rake d having advanced to the edge 12*a* of the opening as it discharges its load through the opening while gate 26 remains in its open position, a position it will maintain until rake d is fully across the opening. When rake d reaches the same position as rake b has on FIG. 2A rake e will be positioned where rake c is shown positioned in FIG. 2*a*** and a new cycle as described above will commence.

Referring again to FIG. 1 during parallel operation of the two series arranged mills depicted, the total flow of bagasse or cane entering from a supply conveyor or a previous mill at entrance point 21 is conveyed in distinct and separate piles to opening 12. The timed, open-close action of gate 26 allows, for instance, every-other-load to leak through the first opening 12 while the remaining loads are conveyed over the momentarily closed opening 12 and are discharged through the second opening 13. The interrupted, intermittent flow of material discharging through opening 12 is formed into a continuous blanket, free of abrupt variations in thickness and controlled as to maximum thickness while being transported to mill roller entrance 41 of the first 17 of two mills being paralleled. After processing by said mill the material is discharged over chute 32 onto conveyor 33. Meanwhile, the other portion of the material, which is being discharged through opening 13 over chute 14 flows into the receiving end of the conveying means feeding the next, or second, of the two mills 28 to be delivered to that mill to be processed. The material processed by the third mill is then discharged over chute 16 onto the common receiving conveyor 33.

Series operation without any process interruption is achieved by latching or stopping gate 26 in its open position. In that case all the material entering at entrance 21 flows through the opening 12 onto the feed conditioner and is processed in its totality by the first mill 17. The material processed by the first mill is directed, by lowering swing gate 15, onto the rear portion of the feed conveyor feeding the next mill to be processed by it and later discharged onto conveyor 33 for conveyance to another mill, or if this is the last mill in the milling tandem, as shown, away from said tandem.

Bypassing of a particular mill, an important use of the device of the invention, is accomplished by closing gate 26 of the particular mill, thus causing all the bagasse to flow over the closed opening 12 leading to the first mill 17 and to be discharged through opening 13 leading to the next mill 28. In this way, the first mill may be taken off the line for inspection or repairs without process interruption.

Similarly, by holding gate 26 in its open position, all the bagasse being conveyed is discharged through opening 12. Swing gate 15 is positioned in its raised position causing all the material being discharged from mill 17 to flow down chute 32 and onto conveyor 33. Since no material reaches the second mill 28 it is bypassed.

The discharge of material through the opening 12 leading to the first mill is of an intermittent, interrupted nature due to the spaced form in which the material is conveyed by the rakes, assisted by the action of the reciprocating or splitter gate 26 when the latter is in operation during the paralleling process.

This type of feeding generally would have a detrimental effect on the operation of a mill being fed. Therefore, the present invention provides for means to re-form this spaced discharge into a continuous feed blanket and to treat the continuous feed blanket to eliminate abrupt changes in its thickness (commonly called feed blanket wrinkles) which are common in the cane milling process, while providing means also to prevent mill over-feeding, a very detrimental condition that causes a mill to stop-up or choke, causing it to refuse all feed.

Figure 3B:
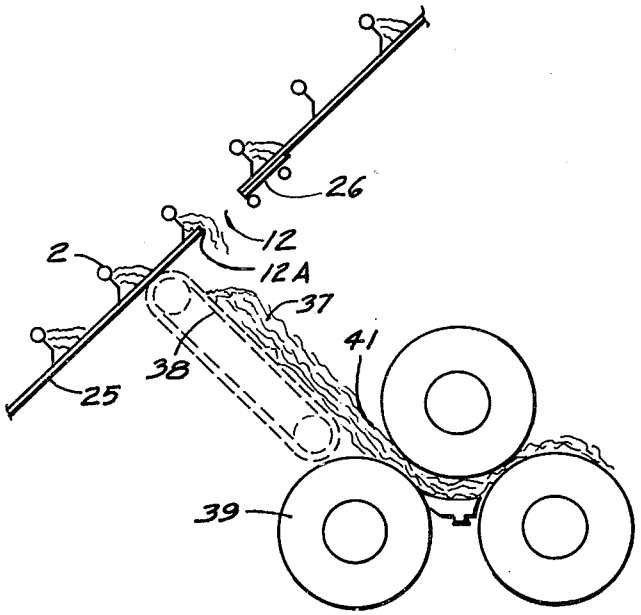
Figure 3A:
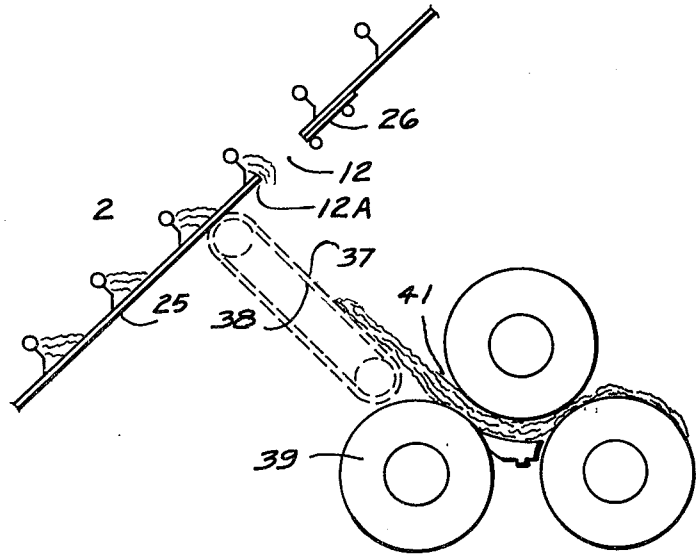

FIG. 3*a* is a cross-sectional elevation view of the feed conditioner portion of the apparatus of the invention. It consists primarily of a specially inclined apron conveying means located between the discharge opening 12 and the mill entrance opening 41. Its conveying motion is transmitted through a suitable chain or gear drive (not shown) from the milling rollers 39 and thus its speed is always proportional to the mill roller speed. Its upper active conveying surface 38 is inclined downwardly to cause the fibrous material entering through opening 12 to slide down this moving surface and to come to rest upon the rear surface of the material previously discharged and being conveyed toward the mill entrance 41. The angle of inclination of this conveying surface is selected in a special relationship to the fiber length of the material being handled which in turn is in a relationship to the sequential position of the mill in the milling tandem so that in conjunction with the traveling speed of the conveying surface, which is in turn in a direct special relationship to the surface speed of the mill roller 39, a feed blanket of normal thickness is established for the particular mill in question.

If the angle of inclination of conveying surface 28 is too steep, the material would tend to accumulate in a pile at the lower end of the inclined surface, while if it is made too shallow a steady state feed blanket thickness is formed which is undesirably thin. It has been found that the fiber length and its density and moisture content have a marked effect on the selection of the proper angle of inclination to achieve the desired blanket thickness. Another factor entering into the selection of this angle and which is an important result, sought by most when using the apparatus of the invention, is the elimination of abrupt variations in feed blanket thickness such as would be caused by momentary slippage of previous mills, partial stoppages, etc. This angle plays an important role in accomplishing this, since it must be such that as a surge in feed enters the device and falls upon the rear of the already formed blanket, it does not form itself into an abrupt change in thickness, but rather the material projecting above the previously established blanket is caused to slide over the upper surface of the previously established blanket distributing itself in a gradually diminishing fashion over said surface, changing what would have been an abrupt change in thickness into one that is gradual in nature.

The lower edge 12*a* of opening 12 is located in such a relationship to the upper reach of the inclined apron conveying surface, that it extends beyond the point of intersection of the inclined bottom of casing 25 and the extension of inclined surface 28 by a given amount so as to cause the bagasse being discharged through the opening to impact upon the apron surface at a point 37 a given distance below the upper reach of the apron conveyor. In this manner if an average feed blamnket thickness is formed that is insufficient for a given apron speed to transport to the mill entrance the amount of material entering through opening 12 the feed blanket will be formed more rapidly than it moves towards the mill. When that happens, the location where the feed blanket is being formed on the moving inclined surface 38 moves closer to the opening 12, a condition which ultimately will cause the material being discharged through opening 12 to begin partially to fall upon the top surface of the already formed feed blanket. See FIG. 3*b*, thus causing said blanket to gradually increase in thickness until a blanket thickness is formed that corresponds to the new condition of flow at that particular conveying speed.

Control means C are provided to limit the length of aperture 12 preferably through adjustable limits on the degree of opening of its gate. By this means, it is possible to limit the maximum thickness which the feed blanket being formed can reach since this thickness will be in a relation to the size of this aperture.

Any amount of material reaching this entrance in excess of that which would cause the thus-restricted opening to be filled is carried over the filled opening 12 and discharged through the second opening 13 leading to the next mill. Thus a surge in feed that would have caused a given mill to be overfed, resulting in a likely mill choke, results instead in a partial, temporary by-pass of material to the following mill, avoiding in this manner a mill shut-down.

FIG. 4 shows an arrangement by which the feeding device of the invention may be utilized with the common apron type intermediate carriers usually used between mills, both to provide parallel or series operation. The flow of material and the manner in which it operates is similar to the above described, except that an additional swing gate 19 may be desirable but not necessary in order to provide an extension to the chute bottom plate.

Figure 6C:
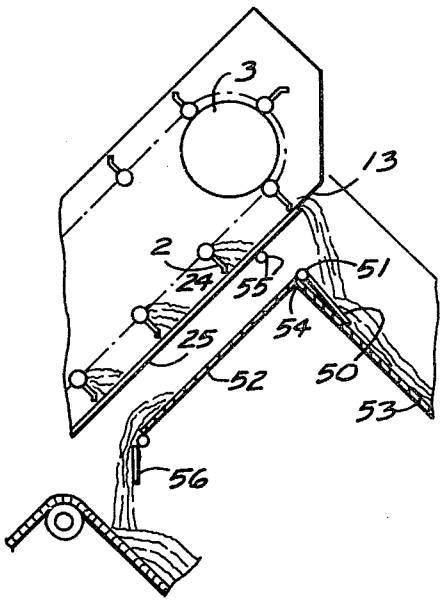

An alternate way to achieve the split in the flow of bagasse between two parallel mills is shown in FIGS. 5–6c. This alternative provides for only one opening 13 on the conveying and metering device. This opening is located near the upper reach of the device and is a desirable alternative when the space between the two subsequent mills allows.

Situated below the single opening 13 in a selected relationship to the lower edge of this opening, is pivot shaft 51 of swing gate 50. Below this swing gate, two oppositely inclined chutes 52 and 53 are located with their surfaces meeting in a common apex 54 which is located adjacently below the swing gate pivot shaft 51. The chutes are oriented in opposite directions, one leading to the upper reach of the feed conditioning device feeding the first 17 of the two mills to be paralleled. The second chute 53 spans over the first mill and leads toward the rear portion of the conveying means that feeds the second or following mill 28. The swing gate is provided with a reciprocating back and forth motion through hydraulic, pneumatic mechanical or other such control means C. This action is timed and synchronized with the arrival of the rakes at opening 13 so that as a rake-load of material is discharged through opening 13, swing gate 50 is at the limit of its upward stroke with its upper surface inclined in the direction of chute 52. Thus, the material being discharged slides over the inclined surface of the gate onto chute 52 towards the upper reach of a feed conditioner 16 leading to the first mill 17. After the rake-load of material has been discharged and the void space 24 between loads reaches opening 13 (providing a lapse of time of no material flowing through said opening), swing gate 50 is made to stroke downwardly until it assumes, at the end of this downward stroke, an inclined position in the direction of chute 53 leading to the second mill. As the next rake-load of material is discharged through opening 13 it will flow over the thus-momentarily-directed gate surface onto chute 53 leading to a second mill.

Figure 6B:
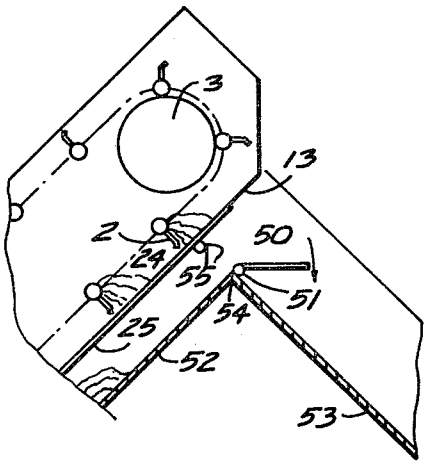
Figure 6A:
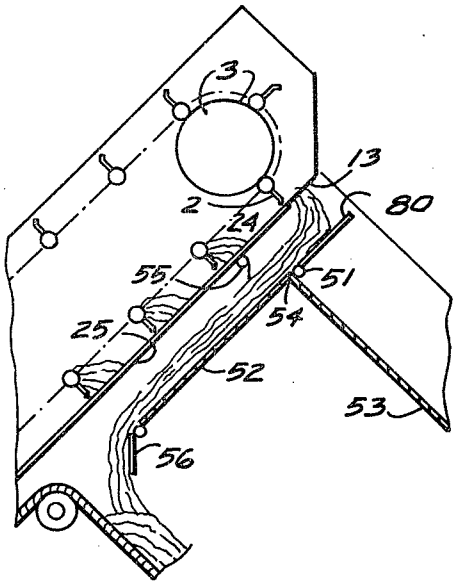

FIG. 6a shows the gate 50 at the limit of its upward stroke with its inclined upper surface directing the material being discharged by a first rake onto chute 52 which leads to a first mill.

FIG. 6b shows the gate at mid-stroke, swinging downwardly as a void space occurs over opening 13.

FIG. 6c shows the gate at the end of its downward stroke with its upper face inclined towards the other chute 53 causing the second rake-load of material which is being discharged through opening 13 to flow onto chute 53 towards a second mill.

Means are provided in this embodiment also to regulate maximum feed blanket thickness to prevent overfeeding. Referring to FIG. 6a, adjustable gate 56 serves this function since it can be adjusted to provide a variable length opening between its lower lip and the feed conditioner apron conveyor surface. Thus, a blanket thickness cannot be formed that exceeds this opening. Another adjustable swing gate 55 is provided at the upper reach of chute 52 so that, if prolonged delivery of material to the first mill through chute 52 in excess of ability of that mill to process it takes place, the spot for the formation of the feed blanket will move up from the feed conditioner apron surface onto the chute surface 52, in which event it is desirable that it does not exceed in thickness that for which maximum thickness adjustable gate 56 has been adjusted. Otherwise, the restriction caused by this gate and the apron conveyor surface would result in a probable plugging at this point. By adjusting gate 55 to produce an opening, of a length between its lower edge and chute 52 upper surface, that does not exceed the maximum feed blanket thickness set by previous adjustment of gate 56, plugging at that point is prevented.

The apparatus of the invention, although very specially suited to provide means to parallel two sequential mills in an otherwise conventional series roller milling tandem, is also very well suited and will provide superior feeding means to individual series mills by supplying these mills with a feed blanket that has been treated to eliminate feed blanket wrinkles and mill over-feeding, both of which have serious detrimental effect on milling capacity and recovery efficiency while providing unassisted means to by-pass fully or partially a mill equipped with the device of the invention, momentarily as in the event of large surge in feed or for a longer period as for mill inspection, repairs, or other forms of mill outage.

It should be apparent that the method and apparatus for feeding a mill as described hereinabove, possesses each of the attributes set forth in the specification under the heading "Summary of the Invention" hereinbefore. They can be modified to some extent without departing from the principles thereof as they have been outlined and explained in this specification.

What is claimed is:

1. A feeding device for a sugar cane mill having a plurality of driven rolls with a feed inlet between two of these rolls, said feeding device comprising:

means providing a conveying surface having means providing a slot therethrough;

gate means juxtaposed with said conveying surface and being movable between a first position wherein said gate means is at least partially withdrawn from said slot along the length of said conveying surface so that the slot is corresponding at least partially open, and a second position wherein said gate means substantially fully occludes said slot and provides an extension of said conveying surface along the length of said slot;

means for accepting a supply of sugar cane stalks, bagasse and juice, or bagasse, juice and water and for pushing said supply lengthwise of said conveying surface in a succession of longitudinally spaced quanta;

chute means juxtaposed with a downstream end of said conveying surface, beyond said slot and functionally extending beyond said mill, for forwarding beyond said mill any of said quanta, or any portions thereof, which are not delivered through said aperture;

inclined surface means being provided below the conveying surface means and extending obliquely downwards from upstream of the upstream extent of said aperture, to juxtaposition with said feed inlet; and means for moving said gate between said first and said second position thereof, so that when some quanta are juxtaposed with the slot, the aperture is open, but when the remaining quanta are juxtaposed with said slot the aperture is closed, whereby:

when the aperture is closed by the gate, or by the build-up of preceding quanta of said material or any portions thereof upon said inclined surface means sufficiently to occlude said aperture, correspondingly succeeding quanta are pushed past said slot and onto said chute until the aperture is opened by the gate or until the buildup is worked off by the mill, respectively.

2. The feeding device of claim 1, further including:

control means operatively connected to the gate means and timed with respect to said accepting and pushing means, for moving said gate means between said first and second positions only between times when a quantum of said material is superjacent the site of said aperture.

3. The feeding device of claim 1, wherein:

said control means includes stroke length adjustment means which is adjustable for regulating the length of said aperture compared with the potential length thereof defined by the length of said slot when gate means in the first position thereof.

4. The feeding device of claim 1, wherein:

said conveying surface is provided with a forwardly inclined disposition.

5. The feeding device of claim 4, wherein:

said accepting and pushing means comprises: at least two, transversally spaced endless chains entrained about a lower, rear set of sprockets, and about a forward, upper set of sprockets at least one set of which being rotatably driven; and a plurality of transversally extending, longitudinally spaced rakes, each being so used to said two endless chains and depending therefrom into successive, sweeping relationship with said conveying surface as said chains are driven on said set of sprockets.

6. The feeding device of claim 4, wherein:

said inclined surface means provided below said conveying surface means has the upstream end thereof disposed a predetermined distance upstream of said slot whereby, normally, said material when fed through said aperture lands upon said inclined surface means intermediate the feed inlet of said mill and the upstream end of said inclined surface means.

7. The feeding device of claim 6, wherein:

said inclined surface means is provided by an upper run of an endless conveyor belt, which belt is entrained about drive rolls which are driven from said mill driven rolls in proportion to the rotation thereof.

8. A sugar cane mill construction, including:

a first sugar cane mill having a plurality of driven rolls with a feed inlet between two of these rolls and a feed outlet between two of these rolls;

a second sugar cane mill having a plurality of driven rolls with a feed inlet between two of these rolls and a feed outlet between two of these rolls;

the second sugar cane mill being arranged downstream of the first sugar cane mill;

first and second inclined surface means each extending obliquely forwardly and downwardly to juxtaposition with the feed inlet of the respective of said first and second sugar cane mills, each inclined surface means having an upper, upstream end rearwardly thereof;

first and second conveyor means each for providing an advancing supply of sugar cane stalks, bagasse and juice or bagasse, juice and water, separated into a succession of longitudinally spaced quanta, associated with a respective one of said first and second mills;

chute means for functionally interconnecting the downstream end of the first conveyor means with the upstream end of the second conveyor means;

the upstream end of the first and second inclined surface means being juxtaposed with the respective of said first and second conveyor means for receiving the respective supplies therefrom;

supply splitter means associated with said first conveyor means and being reciprocable between a first condition wherein the quanta of supply provided by the first conveyor means are provided to said first inclined surface means, and a second condition wherein the quanta of supply provided by the first conveyor means are provided to said chute means; and means for moving said supply splitter means between the first and second conditions thereof.

9. The sugar cane mill construction of claim 8, further comprising:

gate means associated with the feed outlet of said first sugar cane mill;

a take-away conveyor means associated with said feed outlet for conveying away from the first mill the supply which has been processed through the first mill;

the gate means being interposed in the take-away conveyor means and movable between a first position wherein the supply processed by the first mill is forwarded past the gate means to the take-away conveyor and a second position wherein the supply processed by the first mill is shunted past the gate means, to the said second conveyor means; whereby the following possible flow paths are provided:

a. with said supply splitter means in said first condition and said gate means in said first position, the quanta of said supply are advanced from the first conveyor means, to the first inclined surface means, through the first mill, and to the take-away conveyor means, thus by-passing the second mill;

b. with said supply splitter means in said first condition and said gate means in said second position, the quanta of said supply are advanced from the first conveyor means, to the first inclined surface means, through the first mill to the second conveyor means to the second inclined surface means and through the second mill, the first and second mills thus being connected in series;

c. with said supply splitter means in said second condition and said gate means in said second position, the quanta of said supply are advanced from the first conveyor means to said chute means, to said second conveyor means, to said second inclined surface means and through said second mill, thus by-passing the first mill; and d. with said supply splitter means in said second condition and said gate means in said first position, the quanta of said supply are advanced from the first conveyor means to aid chute means, to said second inclined surface means, and through said second mill, thus by-passing the first mill.

10. The sugar cane mill construction of claim 9, further including:

control means for said supply splitter means for periodically shifting said supply splitter means back and forth between the first and second conditions thereof, whereby, provided the gate means is in the second position thereof, the first and second mills are effectively connected in parallel.

11. The sugar cane mill construction of claim 10 wherein:

said control means shifts said supply splitter means between the first and second conditions thereof once between the passing of each two succeeding quanta so that alternate quanta are advanced through the first mill and the remaining half of the quanta are advanced through the second mill.

12. A method for feeding a sugar milling tandem which includes at least two mills in succession, each having a feed inlet and a feed outlet, said method comprising:

a. advancing a feed blanket of sugar cane material toward the inlet of the first mill;

b. spacing the advancing feed blanket into a plurality of discrete, longitudinally spaced quanta;

c. shunting a first number of from zero to all of said quanta further toward the inlet of the first mill in a first stream and the remainder of said quanta in a second stream toward the inlet of the second mill;

d. when said first number is larger than zero, reforming the first stream into a first, substantially uniformly thick, continuous first feed blanket and advancing that first feed blanket through the first mill; and e. when said remainder existant, reforming the second stream into a second, substantially uniformly thick, continuous second feed blanket and advancing that second feed blanket through the second mill.

13. The method of claim 12, further comprising:

when said first number is larger than zero, attempting to pass said first number of quanta through an aperture of predetermined size for gauging the uniformity of thickness of said first stream as said first stream is being formed and bucking such excess as will not pass through said aperture to step (e) for inclusion in said second stream as said second stream is being formed.

14. The method of claim 12, wherein:

said first number is zero, whereby said first mill is effectively by-passed.

15. The method of claim 12, wherein:

said first number is all.

16. The method of claim 15, further including:

forwarding the first stream of sugar cane material from the outlet of the first mill to step (e) to provide said remainder.

17. The method of claim 12, wherein:

said first number is alternately zero and all, according to a timed alternation wherein only every other quantum in succession is shunted further toward the inlet of the first mill, and thus the remainder of said quanta is constituted by half of said quanta.

* * * * *